United States Patent [19]

Burnham

[11] Patent Number: 4,982,463

[45] Date of Patent: Jan. 8, 1991

[54] VERTICALLY ADJUSTABLE HOLDERS FOR THE SUPPORT FOR THE MATTRESS OF A CHILD'S CRIB

[75] Inventor: Benjamin K. Burnham, Merrimack, N.H.

[73] Assignee: Gem Industries Inc., Gardner, Mass.

[21] Appl. No.: 537,257

[22] Filed: Jun. 13, 1990

[51] Int. Cl.[5] ..... A47D 7/03

[52] U.S. Cl. ..... 5/11; 5/93.1; 5/209

[58] Field of Search ..... 5/11, 93.1, 207, 209

[56] References Cited

U.S. PATENT DOCUMENTS

| | | | |
|---|---|---|---|
| 2,311,892 | 2/1943 | Uline | 5/11 |
| 2,357,218 | 8/1944 | Merritt | 5/11 |
| 2,433,023 | 12/1947 | Bukolt | 5/207 |
| 2,447,722 | 8/1948 | Webb | 5/11 |
| 4,850,066 | 7/1989 | Benoit | 5/93.1 X |
| 4,951,330 | 8/1990 | Burnham | 5/93.1 |

*Primary Examiner*—Michael F. Trettel

*Attorney, Agent, or Firm*—Charles R. Fay

[57] ABSTRACT

A structure for supporting a mattress in a crib so that it is easily, manually, vertically adjustable and comprising a bracket at each corner of the crib inside the crib, the brackets each having a track or guide for it to slide on and a socket for the reception of a part of the mattress support in an easily detachable manner. Each bracket has a spring-biassed hook on a plate but slidable relative to the bracket and its guide, and notches on the guide receiving the hook so that an upward and then a horizontal motion is needed to free the hook from the guide and allow adjustment of the bracket vertically along the guide.

9 Claims, 2 Drawing Sheets

VERTICALLY ADJUSTABLE HOLDERS FOR THE SUPPORT FOR THE MATTRESS OF A CHILD'S CRIB

BACKGROUND OF THE INVENTION

Modern structures for cribs for infants emphasize safety for the occupant and ease of operation both in setting up the crib initially and in the present case, ease and safety of the adjustment of the height of the mattress. As the child grows, it is usually desired to lower the mattress whether a dropside is present or not. Furniture of this kind is sold KD in a flat cardboard box, and the owner has to assemble the end panels, sides, mattress support system, et. al. It is desirable that this should be accomplished, as well as the adjustment, without tools of any kind, while maintaining the safety factor required.

The present invention provides two pairs of holders for the mattress support that are easily applied to the corner posts of the crib, the two pair being alike but made in mirror images because all four present deep recesses facing inwardly of the crib in a lengthwise direction to accept and hold longitudinal extensions at the side end portions of the mattress support for the purpose described, each of the four holders being individually easily vertically adjustable on its respective corner post.

SUMMARY OF THE INVENTION

Mattress support mounting means in a child's crib so that the mattress may be adjusted as the child grows. Upright guides are provided at each of the four corners of the crib and each guide has a bracket on it for sliding up and down, these being means on each bracket to receive a part of the mattress support. The support is usually make of link fabric with angle iron edges. The guides are provided with series of concealed, restricted entry slots to accommodate hooks on the brackets that when properly seated in their respective slots, support or hold the brackets in position, and therefore the mattress support. The combination of the hooks and the restricted entry slots require that each bracket be slightly lifted, and then the respective hook retracted, to free the brackets so that they can be adjusted along the guides. Thus, a two motion device for the purpose is provided, an upward motion of the entire bracket and hook together, and then a rectilinear motion of the hook are required to free the hook from its locked position, thereby reducing accidental release of a bracket from its guide.

PREFERRED FORM OF THE INVENTION

Figure 1:
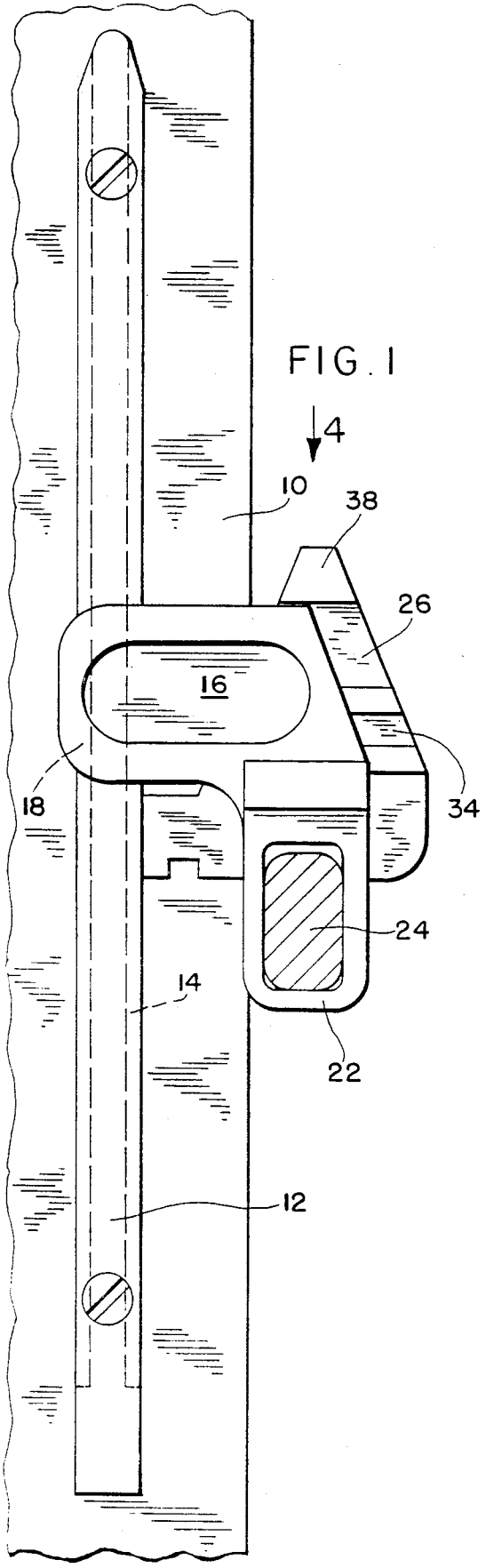
FIG. 1 is an elevational view of one of the four mattress support holders shown in unlatched, vertically adjustable position relative to the guide on which it is mounted.

Only so much of the crib is disclosed as is necessary to explain the present invention and in this connection attention is directed to co-pending application Ser. No. 374,184, filed June 30, 1989, now U.S. Pat. No. 4,951,330, using the usual end panels with corner posts, fixed rear side, and front dropside, as will be clear to anyone who has used such a well-known child's crib. Thus, in FIG. 1 herein, the numeral 10 indicates a corner post, this one being at the front left end of the crib, there being a mirror image thereof the rear left; a showing that is the same at the rear right, and a mirror image at the right front corner post. It is believed that the description herein will be sufficient for one with some knowledge of the art, even if not skilled.

Figure 4:
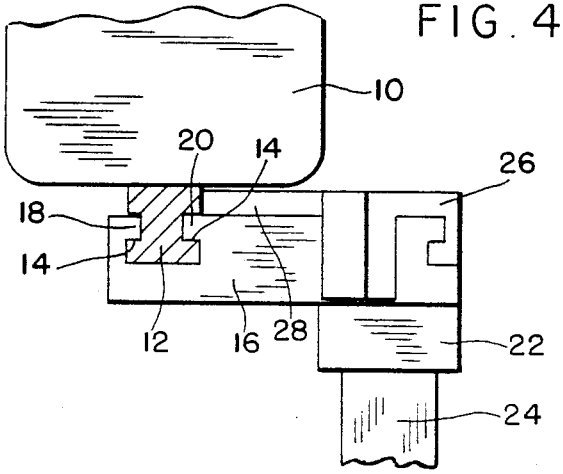
FIG. 4 a top plan view of the holder of FIG. 1, looking in the direction of the arrow 4 in FIG. 1.
Figure 5:
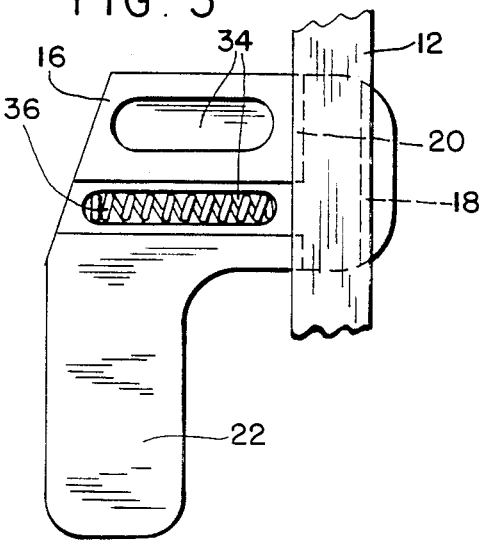
FIG. 5 is an elevational mirror image view of the bracket showing the side partially obscured by the hook plate in FIG. 3.

The corner post 10 has on its side that faces into the crib a guide 12 which has grooves 14 at each edge, as in FIG. 4, forming tracks. A bracket 16 is mounted to slide on the exposed face of guide 12 by having inturned feet 18, 20, riding in the grooves. The bracket has integral therewith a socket 22 that faces inwardly of the crib and receives a part of the mattress support as at 24, FIG. 4. Four brackets are enough to hold the mattress support at each corner.

Figure 2:
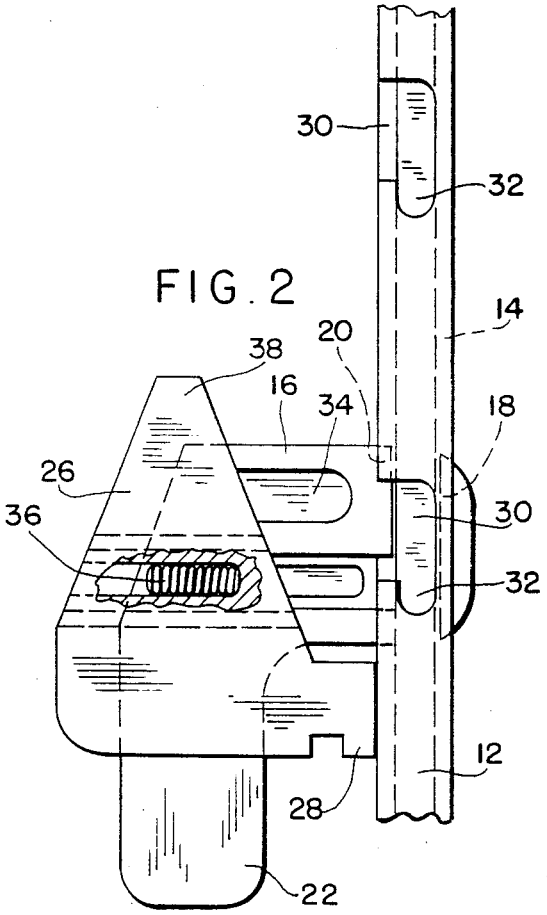
FIG. 2 is an elevational view of the holder of FIG. 1, locked in its adjusting combination, but from the rear of the showing of FIG. 1.
Figure 3:
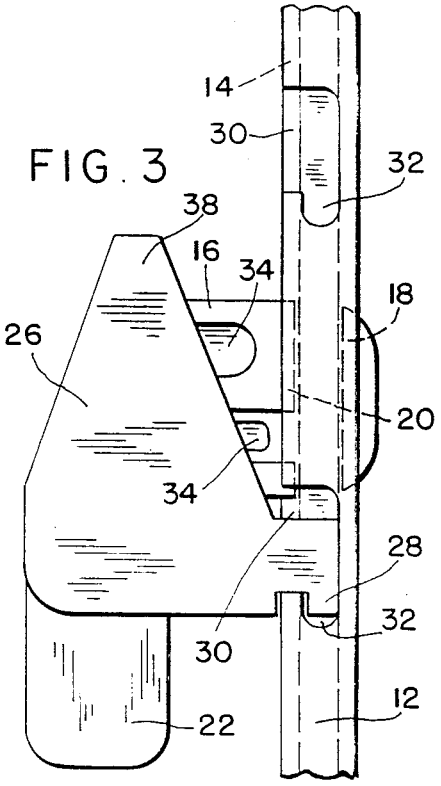
FIG. 3 is a view similar to FIG. 2 but showing the holder locked in position.

Rectilinearly slidable on the bracket there is a vertical plate 26. This plate carries a hook 28 that is fixed with respect thereto and moves therewith. The hook 26 has a length just small enough to easily pass through entry 30 of slot 32, or any of them, slot 32 being longer than the entry 30. The plate 26 is shaped to provide a finger hold, and interengages slidingly on interfitting grooves and edges which form tracks 34 in one of which an elastomeric device 36 normally maintains plate 26 to the right in FIGS. 2 and 3. Hence, the hook 26 rides on the edge of the guide 12, see FIG. 2, and snaps into an aligned entry way to any slot 32, but can be pulled free by the finger of the operator on plate 26 at the right hand edge thereof.

The slots 32 and entrance ways thereto at 30 are located in the track of the guide 12, and are concealed by the guide, as they face the corner post 10 and are covered thereby. They cannot be seen in FIG. 1 but are clearly visible in FIGS. 2 and 3 because the guide in these figures is removed from the corner post and an observer sees the rear side of the guide, normally concealed. Also, the hook plate 26 rises above the bracket 16, as at 38, and is easily engaged by the operator's finger for this reason.

I claim:

1. A child's crib comprising two end panels and two connecting sides, and means to hold adjustably a mattress support in the crib, said means comprising a set of four brackets, the brackets being mounted on the edge portions of the panels adjacent the sides, a vertical guide for each bracket, said brackets being individually mounted on its guide to be vertically adjustable thereon, and means on each bracket and corresponding guide to lock the brackets in adjusted position, means to manually release each bracket with respect to the locking means on the guides to provide for sliding the brackets up and down on the guides, the locking means on the guides comprising vertical slots in the guides, each slot including a portion that provides entry thereto by the locking means on the bracket, said entry portions being shorter than the slots and positioned at the upper portion of each slot, and each locking means on the brackets comprising a hook that can enter the entries of the slots and then move down into the respective slot, whereby adjustment of the mattress support requires lifting the brackets slightly and retracting the hooks out of the entries, elastomeric means biasing the hooks relative to the brackets to enter the slots, said locking means being slidable relative to the brackets against the action of said elastomeric means, and means on each bracket receiving a portion of the mattress support.

2. The crib of claim 1 wherein the motion of the hook is limited to rectilinear motion.

3. The crib of claim 1 including means between the bracket and hook restricting the hook to a rectilinear motion.

4. The crib of claim 1 including interfitting grooves and edges on the hook and on the bracket limiting the hook to a rectilinear path.

5. The crib of claim 1 including a finger operated plate and support for the hook, said last named plate covering the elastomeric means.

6. A child's crib comprising end panels and connected sides, means for vertically adjusting and supporting a mattress support in the crib, there being four guides, one adjacent each corner of the crib, each guide being elongated and having a plain surface, a notched surface, and opposite elongated surfaces, the notched surface being adapted to face an end panel of the crib and the plain surface being exposed to the crib interior, each notch comprising a smaller entry part and a larger receptor part being hidden by the end panel on which the guides are mounted, a bracket on each guide, slidable interengaging means for a corresponding track on each bracket, means on each bracket to accept a part of the mattress support, and a slidable hook bearing plate on each bracket, each said plate including a hook adapted to enter a notch when aligned with an entry notch part, and elastomeric means urging the said plate and its hook to enter the notch, the hooks being adapted to fall in the notches partly into the receptor parts thereof, whereby, to adjust the mattress, the brackets must be raised slightly and then the hook plate retracted against the action of the elastomeric means to completely free the brackets from the notches for vertical motion of the mattress support.

7. The child's crib of claim 6 including interengaging tracks on each bracket with corresponding tracks on each hook plate.

8. The child's crib of claim 6 including means on bracket and corresponding hook plate to restrain the hook plate to a rectilinear motion.

9. The child's crib of claim 8 wherein the elastomeric means in horizontal.

* * * * *